US009136655B2

(12) United States Patent
Moon et al.

(10) Patent No.: US 9,136,655 B2
(45) Date of Patent: Sep. 15, 2015

(54) CABLE CONNECTION DEVICE

(75) Inventors: Young-Chan Moon, Gyeonggi-Do (KR); Sung-Hwan So, Gyeonggi-Do (KR); Oh-Seog Choi, Gyeonggi-Do (KR); Youn-Moon Han, Gyeonggi-Do (KR)

(73) Assignee: KMW Inc., Hwaseong, Gyeonggi-Do (KR)

( * ) Notice: Subject to any disclaimer, the term of this patent is extended or adjusted under 35 U.S.C. 154(b) by 0 days.

(21) Appl. No.: 14/006,933

(22) PCT Filed: Mar. 20, 2012

(86) PCT No.: PCT/KR2012/001984
§ 371 (c)(1), (2), (4) Date: Sep. 23, 2013

(87) PCT Pub. No.: WO2012/128536
PCT Pub. Date: Sep. 27, 2012

(65) Prior Publication Data

US 2014/0011398 A1 Jan. 9, 2014

(30) Foreign Application Priority Data

Mar. 24, 2011 (KR) ..... 10-2011-0026616

(51) Int. Cl.
*H01R 24/40* (2011.01)
*H01R 12/51* (2011.01)
(Continued)

(52) U.S. Cl.
CPC ..... *H01R 24/40* (2013.01); *H01R 12/515* (2013.01); *H01R 24/50* (2013.01); *H01R 2103/00* (2013.01)

(58) Field of Classification Search
CPC .. H01R 12/515; H01R 24/40; H01R 2103/00; H01R 24/50
USPC ..... 439/578–585, 675, 63
See application file for complete search history.

(56) References Cited

U.S. PATENT DOCUMENTS 4,737,111 A * 4/1988 Minar et al. ..... 439/63
5,532,659 A * 7/1996 Dodart ..... 333/260
(Continued)

FOREIGN PATENT DOCUMENTS

CN 201629411 U 11/2010
DE 3525353 A1 1/1987
(Continued)

OTHER PUBLICATIONS

European Search Report issued Jul. 7, 2014 in corresponding EP Application No. 12 760 152.
(Continued)

*Primary Examiner* — Edwin A. Leon
(74) *Attorney, Agent, or Firm* — Mintz Levin Cohn Ferris Glovsky and Popeo, P.C.; Kongsik Kim; Carolina Säve

(57) ABSTRACT

The present invention provides a coaxial RF cable connection device that connects a coaxial RF cable to a printed circuit board having one side on which a signal transmission pattern is formed and having another side on which a ground plane is formed. The devices has central body with a support opening into which the cable is penetrated and inserted and a solder block with a pair of auxiliary bodies respectively protruded from both sides of the central body. The printed circuit board has a cutting portion formed by cutting and removing a part of the edge. A pair of through holes are formed on both sides of the cutting portion and is soldered on one side of the printed circuit board.

8 Claims, 5 Drawing Sheets

(51) Int. Cl.
*H01R 24/50* (2011.01)
*H01R 103/00* (2006.01)

(56) References Cited

U.S. PATENT DOCUMENTS

| | | | | |
|---|---|---|---|---|
| 6,030,231 | A * | 2/2000 | Sarkiniemi | 439/63 |
| 6,238,218 | B1 * | 5/2001 | Baffert | 439/63 |
| 7,048,547 | B2 * | 5/2006 | Gottwald | 439/63 |
| 2003/0054674 | A1 | 3/2003 | Evans | |

FOREIGN PATENT DOCUMENTS

| | | | |
|---|---|---|---|
| EP | 0 792 529 | A1 | 9/1997 |
| EP | 1 378 025 | A1 | 1/2004 |
| JP | S61149403 | U | 9/1986 |
| JP | H01137070 | U | 9/1989 |
| JP | H0395566 | U | 9/1991 |
| JP | 2003168499 | A | 6/2003 |
| JP | 2009-105008 | A | 5/2009 |
| JP | 2010-238638 | A | 10/2010 |
| KR | 2008-0077838 | A | 8/2008 |
| WO | 97/10629 | A1 | 3/1997 |
| WO | 02/084808 | A1 | 10/2002 |

OTHER PUBLICATIONS

Japanese Office Action issued Sep. 1, 2014, in corresponding JP Application No. 2013-558797.

* cited by examiner

Fig. 11
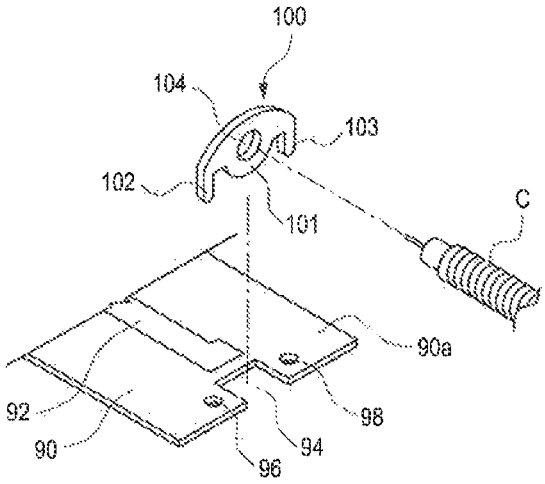
Fig. 12
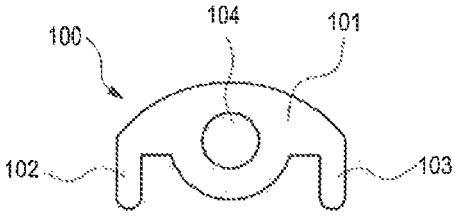
[Fig. 13]
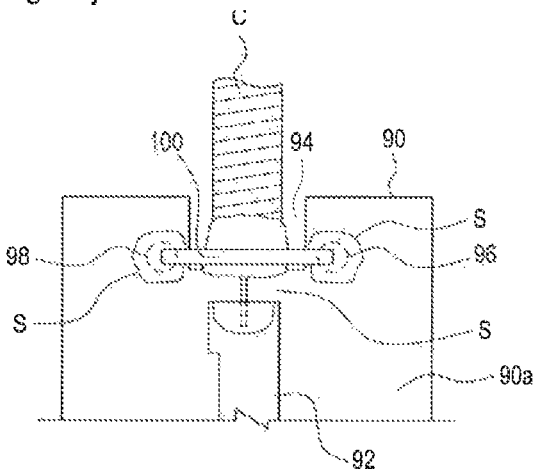
Fig. 14
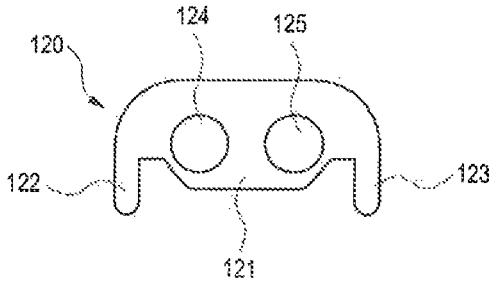

CABLE CONNECTION DEVICE

CROSS-REFERENCES TO RELATED APPLICATIONS

This application is a U.S. national phase application, pursuant to 35 U.S.C. §371, of PCT/KR2012/001984, filed Mar. 20, 2012, designating the United States, which claims priority to Korean Application No. 10-2011-0026616, filed Mar. 24, 2011. The entire contents of the aforementioned patent applications are incorporated herein by this reference.

TECHNICAL FIELD

The present invention relates to a cable connection device for electrically and mechanically connecting a coaxial RF cable to a printed circuit board of a communication system.

BACKGROUND ART

Generally, in a communication system, various electronic elements are mounted on a high-frequency printed circuit board, and a coaxial RF cable is used to transmit and receive signals to/from the electronic elements. Such a coaxial RF cable is a transmission medium for transmitting and receiving signals, in which an internal conductor is enclosed by an internal insulation made of a dielectric substance, the internal insulation is enclosed by an external conductor, and the external conductor is enclosed by an outer peripheral insulation substance.

The coaxial RF cable has been widely used for the communication system because it has been subjected to a less electrical interference and has a loss of electric power. Accordingly, there is need for a connection device for electrically and mechanically connecting the coaxial cable to a ground of a high-frequency printed circuit board.

A conventional coaxial RF cable connection device is disclosed in Korean Patent Application No. 2005-110003 in detail.

However, there is a disadvantage in that the connection device disclosed in Korean Patent Application Serial No. 2005-110003 has a high manufacturing cost. That is, in the conventional connection device, there are problems in that a manufacturing cost is high and a manufacturing method is complicated.

Especially, in connection of two or more coaxial RF cables to a high-frequency printed circuit board, two connection devices which are independently manufactured are used. Therefore, a material cost increases two times, and a connection process become more complicated two or more times, resulting in an increase of a manufacturing cost.

Accordingly, there has been an increasing need for reducing a cost of a device for connecting two or more parallel arranged RF cables to the high-frequency printed circuit board.

SUMMARY OF THE DISCLOSURE

Accordingly, the present invention has been made to solve the above-mentioned problems in the conventional art, and an aspect of the present invention is to provide a coaxial RF connection device which is easily manufactured and of which a manufacturing cost is cheap.

Further, another aspect of the present invention is to provide a coaxial RF cable connection device in which a manufacturing cost can be reduced when a single coaxial RF cable is connected to a printed circuit board, or two or more coaxial RF cables are connected to the printed circuit board.

Furthermore, still another aspect of the present invention is to provide a coaxial RF cable connection device in which parts can be freely designed and easily changed in shape by pressing or etching a brass plate.

In addition, still another aspect of the present invention is to provide a coaxial RF cable connection device which can be advantageous in miniaturization and lightweight.

In order to solve the technical problems, there is provided a cable connection device for connecting a coaxial RF cable to a printed circuit board which has a signal transmission pattern on one surface thereof and a ground on the other surface thereof. The cable connection device includes: a central body having a supporting opening in which the coaxial RF cable is inserted; and a solder block which includes a pair of auxiliary bodies extending from both sides of the central bodies and being stepped in a protruding shape, wherein the printed circuit board has a cutout portion where an edge of the printed circuit board is cutout and removed, and a pair of thru-holes is formed at both sides of the cutout portion, wherein the solder block is soldered to one surface and/or the other surface of the printed circuit board so that the central bodies and the auxiliary bodies extend through and are inserted in the cutout portion and the thru-holes, and wherein at least one central body and cutout portion are provided, and at least one pair of auxiliary body and thru-hole are formed.

As described above, the connection device according to the present invention is miniaturized and lightweight and has a simple structure, resulting in a significant reduction of a manufacturing cost. Especially, the connection device according to the present invention is manufactured by pressing or etching the brass plate, thereby reducing the manufacturing cost, allowing the parts to be freely designed, and allowing a shape to be easily changed.

Further, according to the present invention, the two or more coaxial RF cables are simply connected to a ground, thereby contributing to a reduction of the manufacturing cost. Also, a connection process is simple, thereby reducing a manufacturing cost of a product.

BRIEF DESCRIPTION OF DRAWINGS

The foregoing and other objects, features and advantages of the present invention will become more apparent from the following detailed description when taken in conjunction with the accompanying drawings in which:

FIG. 11 is an exploded perspective view illustrating a structure of a connection device according to a fifth embodiment of the present invention.

FIG. 12 is a front view illustrating a solder block employed to a connection device according to a fifth embodiment of the present invention.

FIG. 13 is a plan view illustrating the connection device according to the fifth embodiment of the present invention.

FIG. 14 is a front view illustrating a solder block employed to a connection device according to a sixth embodiment of the present invention.

DETAILED DESCRIPTION

Figure 1:
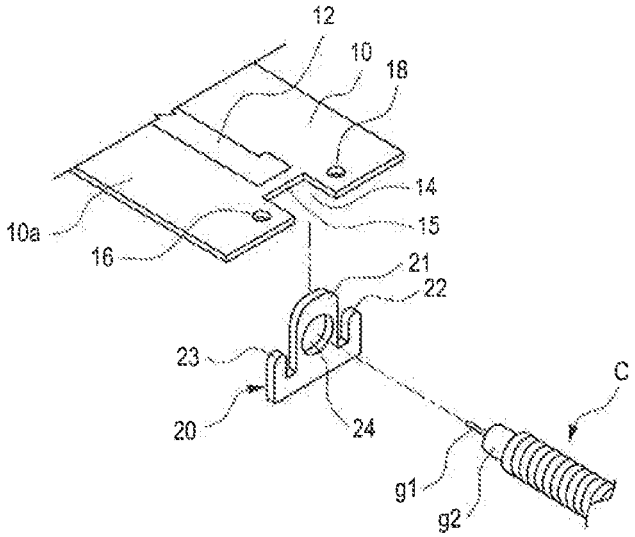
FIG. 1 is an exploded perspective view illustrating a structure of a connection device according to a first embodiment of the present invention.

Hereinafter, a structure of an RF cable connection device according to the present invention will be described with reference to the accompanying drawings. An identical reference numeral denotes the same structural element.

The structure of a coaxial RF cable connection device (hereinafter, referred to as a connection device) according to a first embodiment of the present invention will be described with reference to FIGS. 1 to 4.

As shown in FIGS. 1 to 4, the connection device is one for electrically and mechanically connecting the coaxial RF cable C to a ground 13 and/or a signal transmission pattern 12 of a printed circuit board 10 employed to a communication system, and means a device for use in a stable transmission of signals without Passive Intermodulation Distortion (PIMD).

The connection device includes the printed circuit board 10 and a solder block 20. The printed circuit board 10 has a signal transmission pattern 12 at one surface 10*a* thereof and a ground 13 at the other surface 10*b* thereof. The printed circuit board 10 includes a cutout portion 14 in which apart of an edge is cut out, and a pair of thru-holes 16 and 18 formed at both sides of the cutout portion 14. The cutout portion 14 is formed at a predetermined position of a periphery of the printed circuit board 10 and is an opening which opens outwardly, and the thru-holes 16 and 18 are closed openings with a circular shape. The cutout portion 14 means a space in which a central body 21 of the solder block, which is described later, and the coaxial RF cable C are disposed and soldered, and the thru-holes mean spaces in which auxiliary bodies 22 and 23 of the solder block 20 described later are inserted and soldered. The thru-holes 16 and 18 are paired to include two openings, and the thru-holes 16 and 18 are symmetrically disposed around the cutout portion 14 and opposite to each other.

The coaxial RF cable C includes a central line g1, and a grounding coating g2 for providing the central line g1 with a grounding force. The grounding coating g2 surrounds and protects the central line g1, and contributes to a connection of the central line g1 to the signal transmission pattern 12 prepared to the one surface 10*a* of the printed circuit board and/or the ground surface 13 prepared to the other surface 10*b* of the printed circuit board. Accordingly, the solder block 20 described later electrically connects the central line g1 and the grounding coating g2 of the coaxial RF cable to the signal transmission pattern 12 and/or the ground 13 (shown in FIG. 4) of the printed circuit board by soldering.

Figure 2:
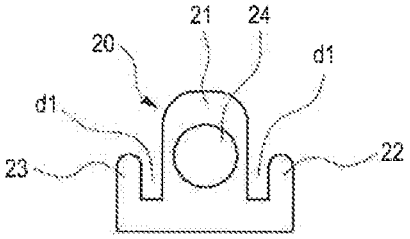
FIG. 2 is a front view illustrating a solder block employed to the connection device according to the first embodiment of the present invention.

As shown in FIGS. 1 and 2, the solder block 20 is a connection terminal which moves from a downward direction to an upward direction around the printed circuit board 10 and is inserted into the cutout portion 14 and the thru-holes 16 and 18 before being soldered to the signal transmission pattern 12 and/or the ground 13 of the printed circuit board, and includes a central body 21 and a pair of auxiliary bodies 22 and 23. The central body 21 has a shape of protruding upwardly and is disposed to extend through the cutout portion 14, which has a supporting opening 24 in which the coaxial RF cable C is inserted. The supporting opening 24 has a diameter large enough to allow the coaxial RF cable C to be inserted in. The auxiliary bodies 22 and 23 have at least one pair which are stepped and extend upwardly from both sides of the central body 21, and penetrate the thru-holes 16 and 18, respectively. Further, the central body 21 extends upwardly rather than the auxiliary bodies 22 and 23. The reason is because the solder block 20 has the opening 24 for supporting the coaxial RF cable C so that the coaxial RF cable C contacts the signal transmission pattern 12 of the printed circuit board.

The central body 21 and the auxiliary bodies 22 and 23 have a stepped portion d1 therebetween, and the stepped portion d1 has a depth in which the center line g1 of the coaxial RF cable extending through the opening 24 for supporting the central body which protrudes through the cutout portion 14 comes in contact with the signal transmission pattern 12 of the printed circuit board. Further, the central body 21 and the auxiliary bodies 22 and 23 are integrally manufactured, and have a curved upper end to be easily inserted into the cutout portion 14 and the thru-holes 16 and 18.

The stepped portion d1 between the central body 20 and the auxiliary body has a depth in which a sectional surface of the grounding coating g2 coated on a peripheral surface of the center line of the coaxial RF cable which extends through the opening 24 for supporting the central body protruding through the cutout portion 14 comes in contact with a surface 15 of the cutout portion in an insertion direction of the coaxial RF cable. In other words, when the solder block 20 is inserted into the cutout portion 14, and the coaxial RF cable C comes in close contact with the supporting opening 24, the sectional surface of the grounding coating g2 keeps in contact with and is latched by the surface 15 of the cutout portion. Accordingly, it is possible to block a movement of the coaxial RF cable C in the insertion direction. In this state, a soldering process is performed.

As described above, a structure in which the coaxial RF cable C keeps in close contact with the cutout portion 14 and the opening 24 for supporting the solder block 20 which is inserted into the thru-holes 16 and 18 will be identically applied to a construction in which the solder block and the coaxial RF cable of the connection device to be described below in various embodiments are arranged.

Further, the solder block 20 may be manufactured by pressing or etching a brass plate in a predetermined shape. Since the solder block 20 is manufactured in this process, it is possible to freely design parts and to easily change a shape.

When the solder block 20 having the above-mentioned structure is inserted in the cutout portion 14 and the thru-holes 16 and 18 of the printed circuit board 10, and then the coaxial RF cable C is soldered to the solder block 20 in a state that the coaxial RF cable C is inserted into the supporting opening 24, the central line g1 of the coaxial RF cable extending through the supporting opening 23 comes in contact with the signal transmission pattern 12, and the upper ends of the auxiliary bodies 22 and 23 extending through the thru-holes 16 and 18 protrude over and are fixed to the printed circuit board 10 by soldering. In addition, the connection device has a structure in that the central body 21 firstly supports the coaxial RF cable C and the auxiliary bodies 22 and 23 supports the central body 21. Therefore, the coaxial RF cable C comes in stable contact with the signal transmission pattern 12. When the solder block 20 is soldered, the solder block 20 keeps in contact with the signal transmission pattern 12 and/or the ground 13.

The connection device is preferably soldered to the printed circuit board at positions where the coaxial RF cable central line g1 is adjacent to or in contact with the signal transmission pattern 12, and the auxiliary bodies 22 and 23 are inserted into the thru-holes 16 and 18 respectively, in order to keep a stability of a connection state.

Figure 3:
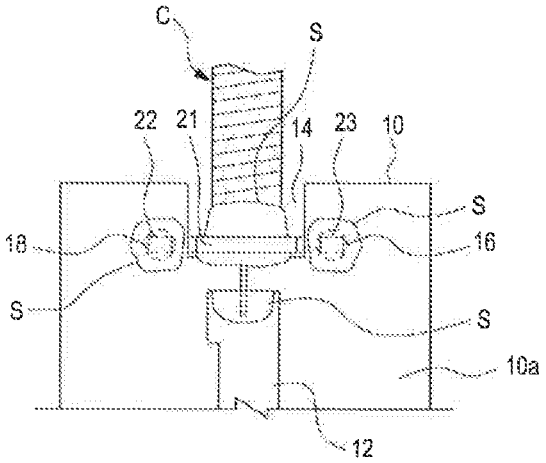
FIG. 3 is a plan view illustrating the connection device according to the first embodiment of the present invention.
Figure 4:
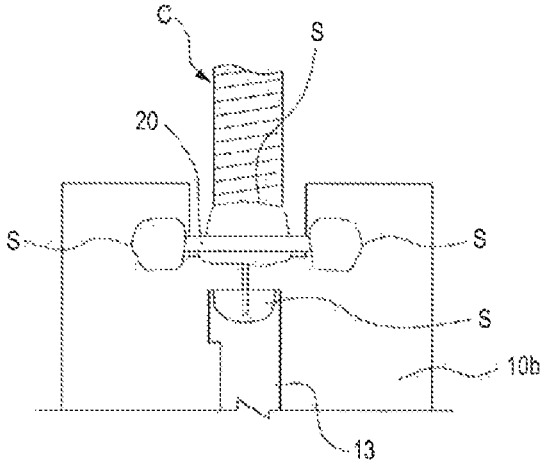
FIG. 4 is a bottom view illustrating the connection device according to the first embodiment of the present invention.

Reference symbols S shown in FIGS. 3 and 4 denote soldered portions.

Figure 5:
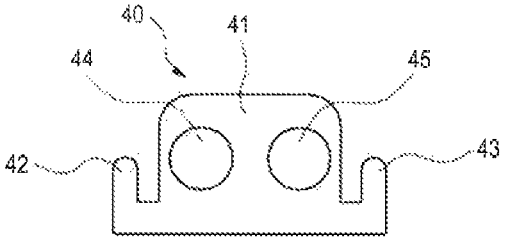
FIG. 5 is a front view illustrating a solder block employed to a connection device according to a second embodiment of the present invention.
Figure 6:
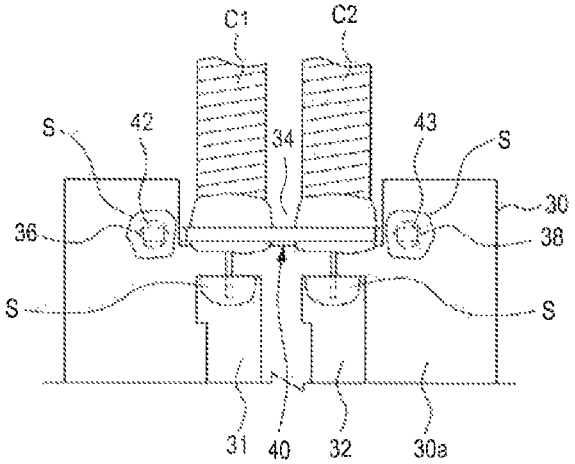
FIG. 6 is a plan view illustrating the connection device according to the second embodiment of the present invention.

A structure of the connection device according to the second embodiment of the present invention will be described with reference to FIGS. 5 and 6. As shown in FIGS. 5 and 6, the connection device according to the second embodiment of the present invention includes two openings 44 and 45 for supporting two coaxial RF cables C1 and C2, in comparison with the connection device shown in FIG. 1. The structure of the connection device will be described with reference to FIGS. 5 and 6.

The connection device includes the printed circuit board 30 and a solder block 40. The printed circuit board 30 includes first and second signal transmission patterns 31 and 32 on one surface 30*a* thereof, first and second grounds (not shown) on the other surface thereof, a cutout portion 34, and a pair of thru-holes 36 and 38 formed at both sides of the cutout portion 34. The cutout portion 34 means a space in which a central body 41 of the solder block 40, which is described later, and the first and second coaxial RF cables C1 and C2 are disposed and soldered, and the thru-holes 36 and 38 mean spaces in which auxiliary bodies 42 and 43 of the solder block 40 described later are inserted and soldered. The thru-holes 36 and 38 are paired to include two openings, and the thru-holes 16 and 18 are symmetrically disposed around the cutout portion 34 and opposite to each other.

The solder block 40 includes a central body 41 and auxiliary bodies 42 and 43, and is a terminal which moves from a bottom surface to an upper surface of the printed circuit board 30 and extends through the cutout portion 34 and the thru-holes 36 and 38, so as to be soldered to the printed circuit board. The central body 41 of the solder block 40 has first and second supporting openings 44 and 45 in which the first and second coaxial RF cables C1 and C2 are inserted and which have a circular shape. The first and second supporting openings 44 and 45 have an identical shape, and are formed in parallel in the central body 41.

The auxiliary bodies 42 and 43 protrude upwardly from both sides of the central body 41, and extend through the thru-holes 36 and 38, respectively. Further, the central body 41 extends upwardly rather than the auxiliary bodies 42 and 43. The reason is because the central body 41 has the first and second supporting openings 44 and 45 in order that the central lines of the first and second coaxial RF cables C1 and C2 are disposed on the first and second signal transmission patterns 31 and 32, respectively. Further, the central body 41 and the auxiliary bodies 42 and 43 are integrally manufactured, and have curved upper ends thereof to be easily inserted into the cutout portion 34 and the thru-holes 36 and 38. Further, the solder block 40 may be manufactured by pressing or etching a brass plate in a predetermined shape. Since the solder block 40 is manufactured in this process, it is possible to freely design parts and to easily change a shape. When the solder block 40 constructed as described above is inserted into the cutout portion 34 and the auxiliary openings 36 and 38 of the printed circuit board, and then the central lines of the first and second RF cables C1 and C2 are in contact with the first and second signal patterns 31 and 32, the central body 41 firstly supports the solder block 40, and the auxiliary bodies 42 and 43 secondly support the central body 41. The solder block 40 having the structure as described above keeps in contact with the first and second signal transmission patterns 31 and 32 and/or the first and second grounds (not shown).

Reference symbols S shown in FIG. 6 denote soldered portions.

Figure 7:
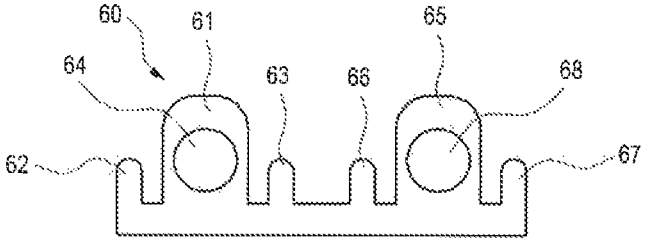
FIG. 7 is a front view illustrating a solder block employed to a connection device according to a third embodiment of the present invention.
Figure 8:
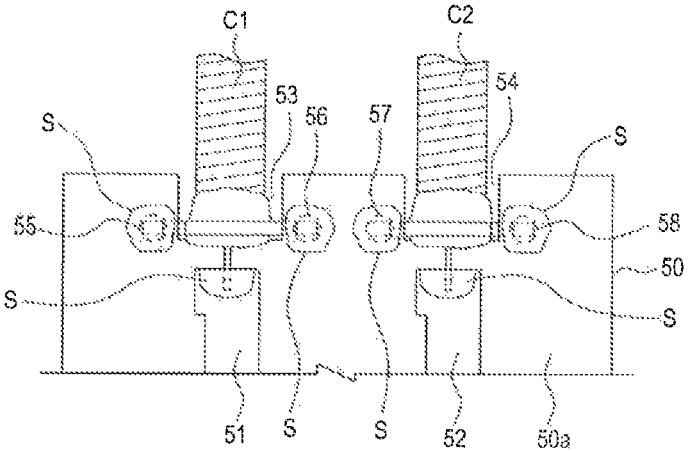
FIG. 8 is a plan view illustrating the connection device according to the third embodiment of the present invention.

A structure of the connection device according to the third embodiment of the present invention will be described with reference to FIGS. 7 and 8. As shown in FIGS. 7 and 8, the connection device according to the third embodiment of the present invention has two identical solder blocks integrally formed, in comparison with the connection device shown in FIG. 1. The structure of the connection device will be described with reference to FIGS. 7 and 8.

The connection device includes the printed circuit board 50 and a solder block 60. The printed circuit board 50 includes first and second patterns 51 and 52 on one surface 50*a* thereof, first and second grounds on the other surface thereof, first and second cutout portions 53 and 54, and two pairs of first and second thru-holes 55, 56, 57 and 58 which are formed at both sides of the first and second cutout portions 53 and 54. The first and second cutout portions 53 and 54 mean spaces in which first and second central bodies 61 and 65 of the solder block 60, which is described later, and the first and second coaxial RF cables C1 and C2 are inserted and soldered, and the first and second thru-holes 55, 56, 57 and 58 mean spaces in which first and second auxiliary bodies 62, 63, 66 and 67 of the solder block described later are inserted and soldered, respectively.

The solder block 60 is a terminal which moves from a bottom surface to an upper surface of the printed circuit board 50 and is inserted into the first and second cutout portions 53 and 54, and the first and second thru-holes 55, 56, 57 and 58 so as to be soldered to the first and second signal transmission patterns 51 and 52, and which stably connects the central line of the coaxial RF cables C1 and C2 to the first and second signal transmission patterns 51 and 52. The solder block 60 includes the first and second central bodies 61 and 65, and two pairs of first and second auxiliary bodies 62, 63, 66 and 67. The first and second central bodies 61 and 65 have an upwardly protruding shape and extend through the first and second cutout portions 53 and 54. The first and second central bodies 61 and 65 include first and second supporting opening 64 and 68 in which the first and second axial RF cables C1 and C2 are inserted. The first and second supporting openings 64 and 68 have an identical shape, and are formed at a distance in the first and second central bodies 61 and 65.

The first and second auxiliary bodies 62, 63, 66 and 67 are formed at both sides of each of the first and second bodies 61 and 65 in an upwardly protruding shape, and extend through the first and second thru-holes 55, 56, 57 and 58, respectively. Further, the first and second central bodies 61 and 65 extend upwardly rather than the auxiliary bodies 62, 63, 66 and 67. The first and second central bodies 61 and 65 and the first and second auxiliary bodies 62, 63, 66 and 67 are integrally manufactured. Further, the solder block 60 may be manufactured by pressing or etching a brass plate in a predetermined shape.

Since the solder block 60 is manufactured in this process, it is possible to freely design parts and to easily change a shape.

When the solder block 60 having the structure as described above is inserted in the first and second cutout portions 53 and 54, and the first and second thru-holes 55, 56, 57 and 58 of the printed circuit board, and the central lines of the first and second coaxial RF cables C1 and C2 are connected to the first and second signal transmission patterns 51 and 52 by soldering, the first and second coaxial RF cables C1 and C2 extending through the first and second supporting openings 64 and 68 are rigidly connected to the first and second signal transmission patterns 51 and 52 disposed on the printed circuit board 50, and upper portions of the first and second auxiliary bodies 62, 63, 66 and 67 extending through the first and second thru-holes protrude over and are fixed to the printed circuit board 50 by soldering. That is, the connection device has a structure in that the first and second bodies 61 and 65 firstly support the first and second coaxial RF cables C1 and C2, and the first and second auxiliary bodies 62, 63, 66 and 67 secondly support the first and second central bodies 61 and 65. Therefore, the connection device stably connects the first and second coaxial RF cables C1 and C2 to the first and second grounds 51 and 52.

Preferably, the connection device is soldered to the printed circuit board at positions where the central line of the first and second coaxial RF cables C1 and C2 are adjacent to the first and second patterns 51 and 52, respectively, and where the first and second auxiliary bodies are inserted in the first and second thru-holes 55, 56, 57 and 58, in order to maintain a stability of a connection state. In the structure as described above, the solder block 60 keeps in contact with the first and second signal transmission patterns 51 and 52 and/or the first and second grounds (not shown).

Reference symbols S shown in FIG. 8 denote soldered portions.

Figure 9:
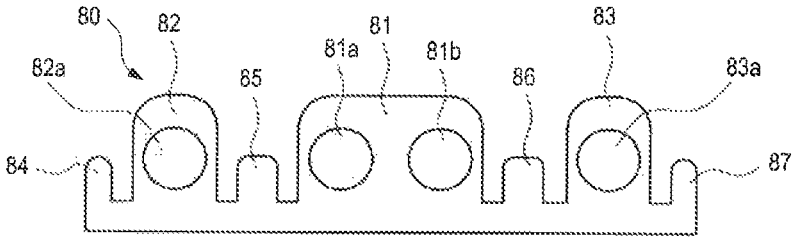
FIG. 9 is a front view illustrating a solder block employed to a connection device according to a fourth embodiment of the present invention.
Figure 10:
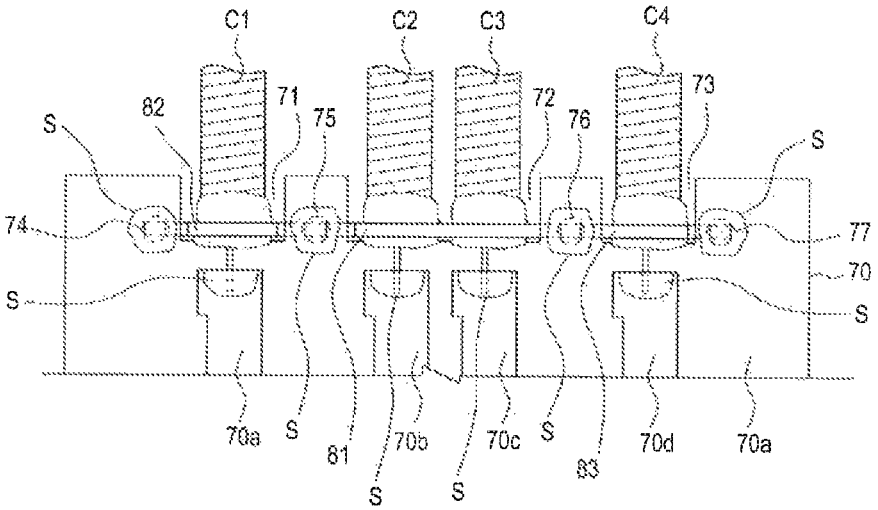
FIG. 10 is a plan view illustrating the connection device according to the fourth embodiment of the present invention.

A structure of the connection device according to the fourth embodiment of the present invention will be described with reference to FIGS. 9 and 10. As shown in FIGS. 9 and 10, the solder block 80 employed to the connection device according to the fourth embodiment of the present invention has a mixed shape of the solder block 40 shown in FIG. 5 and the solder block 60 shown in FIG. 7.

The connection device includes the printed circuit board 70 and a solder block 80. The printed circuit board 70 includes first, second, third and fourth signal transmission patterns 70*a*, 70*b*, 70*c* and 70*d* on one surface 70A thereof, first, second and third cutout portions 71, 72 and 73, and two pairs of first and second thru-holes 74, 75, 76, and 77 formed at both sides of the first and third cutout portions 71 and 73. The first, second and third cutout portions 71, 72 and 73 mean spaces in which first, second and third central bodies 81, 82 and 83 of the solder block, which is described later, and the first, second, third and fourth coaxial RF cables C1, C2, C3 and C4 are inserted and soldered, and the first and second thru-holes 74, 75, 76 and 77 mean spaces in which auxiliary bodies 84, 85, 86 and 87 of the solder block described later are inserted and soldered, respectively. The first and second thru-holes 74, 75, 76 and 77 are paired to include two openings.

The solder block 80 includes first, second and third central bodies and first and second thru-holes, and moves from a bottom surface to an upper surface of the printed circuit board so as to be inserted in the first, second and third cutout portions 71, 72 and 73 and the first and second thru-holes 74, 75, 76 and 77. Then, the solder block 80 is soldered to the first, second, third and fourth patterns 70*a*, 70*b*, 70*c* and 70*d*, and electrically connects the central line of the first, second, third and fourth coaxial RF cables C1, C2, C3 and C4 to the first, second, third and fourth signal transmission patterns. Of course, the coaxial RF cables are configured so that the solder block 80 is electrically connected to the first, second, third and fourth grounds (not shown) on the other surface of the printed circuit board.

The first and second auxiliary bodies 84, 85, 86 and 87 are formed at both sides of each of the first, second and third central bodies 81, 82 and 83 in an upwardly protruding shape, and extend through the first and second thru-holes 74, 75, 76 and 77, respectively. Further, the first, second and third central bodies 82, 81 and 83 extend upwardly over the auxiliary bodies 84, 85, 86 and 87. The reason is because the first, second and third central bodies 82, 81 and 83 include first, second, third and fourth supporting openings 82*a*, 81*a*, 81*b* and 83*a* in order to connect the first, second, third and fourth coaxial RF cables C1, C2, C3 and C4 to the first, second, third and fourth signal transmission patterns 70*a*, 70*b*, 70*c* and 70*d* of the printed circuit board.

The first, second and third central bodies 82, 81 and 83 are integrally formed with the first and second auxiliary bodies 84, 85, 86 and 87, and the solder block 70 may be manufactured by pressing or etching a brass plate in a predetermined shape. Since the solder block is manufactured in this process, it is possible to freely design parts and to easily change a shape.

When the solder block 80 having the structure as described above is inserted into the first, second and third cutout portions 71, 72 and 73, and the first and second thru-holes 74, 75, 76 and 77, and the first, second, third and fourth coaxial RF cables C1, C2, C3 and C4 are soldered to the first, second, third and fourth signal transmission patterns 70*a*, 70*b*, 70*c* and 70*d*, the central lines of the first, second, third and fourth coaxial RF cables C1, C2, C3 and C4 are rigidly connected to the first, second, third and fourth signal transmission patterns 70*a*, 70*b*, 70*c* and 70*d*, and upper ends of the first and second auxiliary bodies 84, 85, 86 and 87 extending through the first and second thru-holes 74, 75, 76 and 77 are fixed to the printed circuit board by soldering. That is, the connection device has the structure in that the first, second, third and fourth coaxial RF cables C1, C2, C3 and C4 firstly support the first, second and third central bodies 82, 81 and 83, and the first and second auxiliary bodies 84, 85, 86 and 87 secondly support first, second and third central bodies 82, 81 and 83. Therefore, the connection device stably connects the central lines of the first, second, third and fourth coaxial RF cables C1, C2, C3 and C4 to the first, second, third and fourth 70*a*, 70*b*, 70*c* and 70*d*.

Preferably, the connection device is soldered to the printed circuit board at positions where the central lines of the first, second, third and fourth coaxial RF cables C1, C2, C3 and C4 are adjacent to or is in contact with the first, second, third and fourth patterns 70*a*, 70*b*, 70*c* and 70*d* respectively, and where the first and second auxiliary bodies are inserted in the first and second thru-holes 74, 75, 76 and 77, in order to maintain a stability of a connection state. In the structure as described above, the solder block 80 keeps in contact with the first and second signal transmission patterns 70*a*, 70*b*, 70*c* and 70*d* and/or the first, second, third and fourth grounds (not shown).

Reference symbols S shown in FIG. 1 denote soldered portions.

A structure of a connection device according to the fifth embodiment of the present invention will be described with reference to FIGS. 11 to 13. As shown in FIGS. 11 to 13, in the connection device according to the fifth embodiment of the present invention, a central body 101 and auxiliary bodies 102 and 103 of the solder block 100 have a downwardly protruding shape and extend from an upper surface to a bottom surface of the printed circuit board so as to be connected to one surface and/or the other surface of the printed circuit board, in comparison with the connection device shown in FIG. 1. The structure of the connection device will be described with reference to FIGS. 11 to 13.

The connection device includes the printed circuit board 90 and a solder block 100. The printed circuit board 90 has a signal transmission pattern 92 on one surface thereof and aground (not shown) on the other surface thereof, and includes a cutout portion 94 and a pair of thru-holes 96 and 98 formed at both sides of the cutout portion 94. The cutout portion 94 means a space in which a central body 101 of the solder block 100, which is described later, and the coaxial RF cable C are inserted and soldered, and the thru-holes 96 and 98 mean spaces in which auxiliary bodies 102 and 103 of the solder block 100 described later are inserted and soldered. The thru-holes 96 and 98 are paired to include two openings, and the thru-holes are symmetrically disposed around the cutout portion 94 and opposite to each other.

The solder block 100 is a terminal which extends from an upper surface to a bottom surface of the printed circuit board 90 and is inserted into the cutout portion 94 and the thru-holes 96 and 98 and which in turn is soldered to the signal transmission pattern 92 to stably connect the central line of the coaxial RF cable C to the signal transmission pattern 92. The solder block 100 includes a central body 101 and a pair of auxiliary bodies 102 and 103. The central body 101 has an upwardly protruding shape and is disposed to extend through the cutout portion 94, which has a supporting opening 104 in which the coaxial RF cable C is inserted. The auxiliary bodies 102 and 103 protrude downwardly from both sides of the central body 101, and extend through the thru-holes 96 and 98, respectively. The central body 101 is integrally formed with the auxiliary bodies 102 and 103, and the solder block 100 may be manufactured by pressing or etching a brass plate in a predetermined shape. Since the solder block 100 is manufactured in this process, it is possible to freely design parts and to easily change a shape.

When the solder block 100 having the structure as described above is inserted in the cutout portion 94 and the thru-holes 96 and 98, and the central line of the coaxial RF cable C is connected to the pattern 92 by soldering, the coaxial RF cable C is rigidly connected to the signal transmission pattern 92 and upper ends of the auxiliary bodies 102 and 103 extending through the thru-holes 96 and 98 are fixed to the printed circuit board 90 by soldering. That is, the connection device has a structure in that the central body 101 firstly supports the coaxial RF cable C and the auxiliary bodies 102 and 103 supports the central body 101. Therefore, the central line of the coaxial RF cable C comes in stable contact with the signal transmission pattern 92.

The connection device is preferably soldered to the printed circuit board at positions where the central line of the coaxial RF cable C is adjacent to the pattern 92 and where the auxiliary bodies extend through the thru-holes 96 and 98, in order to maintain a stability of the connection.

In the structure as described above, the solder block 100 keeps in contact with the signal transmission pattern 92 and/or the ground surface (not shown).

Reference symbols S shown in FIG. 13 denote soldered portions.

Figure 15:
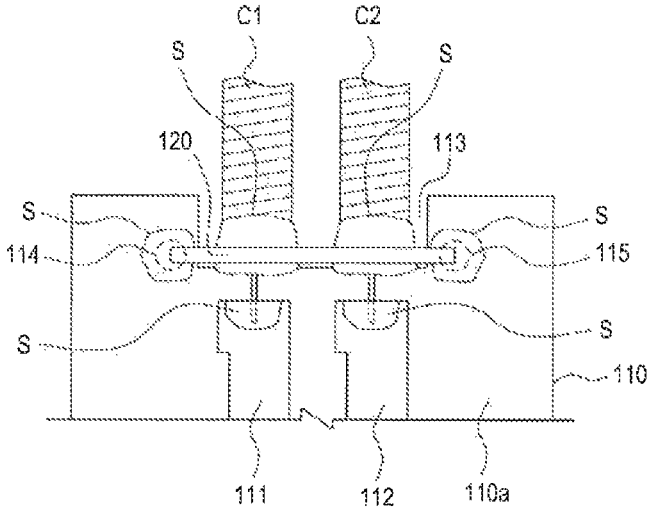
FIG. 15 is a plan view illustrating the connection device according to the sixth embodiment of the present invention.

A structure of a connection device according to the sixth embodiment of the present invention will be described with reference to FIGS. 14 and 15. As shown in FIGS. 14 and 15, the solder block 120 employed to the connection device according to the sixth embodiment of the present invention has two supporting openings 124 and 125 in the central body 121, in comparison with the solder block 100 shown in FIG. 12. The structure of the connection device will be described with reference to FIGS. 14 and 15.

The connection device includes the printed circuit board 110 and the solder block 120. The printed circuit board 110 has first and second signal transmission patterns 111 and 112 on one surface 110*a* thereof and first and second grounds (not shown) on the other surface thereof, and includes a cutout portion 113 and a pair of thru-holes 114 and 115 formed at both sides of the cutout portion 113. The cutout portion 113 means a space in which a central body 121 of the solder block 40, which is described later, and the first and second coaxial RF cables C1 and C2 are inserted and soldered, and the thru-holes 114 and 115 mean spaces in which auxiliary bodies 122 and 123 of the solder block described later are inserted and soldered. The thru-holes 114 and 115 are paired to include two openings, and the thru-holes are symmetrically disposed around the cutout portion 113 and opposite to each other.

The solder block 120 is a terminal which extends from an upper surface to a bottom surface of the printed circuit board 110 and is inserted into the cutout portion 113 and the thru-holes 114 and 115 and which in turn is soldered to the signal transmission patterns 111 and 112 to stably connect the central lines of the first and second coaxial RF cables C1 and C2 to the signal transmission patterns 111 and 112. The solder block 121 includes a central body 121 and a pair of auxiliary bodies 122 and 123. The central body 121 has an upwardly protruding shape and is disposed to extend through the cutout portion 113, which has first and second supporting openings 124 and 125 in which the coaxial RF cables C1 and C2 are inserted. The first and second supporting openings 124 and 125 have an identical shape, and are formed in parallel in the central body 121.

The auxiliary bodies 121 and 123 protrude downwardly from both sides of the central body 121, and extend through the thru-holes 114 and 115, respectively. Further, the central bodies 122 and 123 extend downwardly rather than the auxiliary bodies 122 and 123. Further, the solder block 120 may be manufactured by pressing or etching a brass plate in a predetermined shape. Since the solder block 120 is manufactured in this process, it is possible to freely design parts and to easily change a shape.

When the solder block 120 having the structure as described above is inserted in the cutout portion 113 and the thru-holes 114 and 115, and the center line of the first and second coaxial RF cables C1 and C2 are soldered to the first and second patterns, it is preferable to solder positions where the central lines of the coaxial RF cables C1 and C2 are adjacent to or in contact with the signal transmission patterns, and the thru-holes 114 and 115 in which the auxiliary bodies are inserted, in order to maintain a stability of the connection.

At this time, the solder block 120 keeps in contact with the first and second signal transmission patterns 31 and 32, and/or the first and second grounds (not shown, provided on a bottom surface of the printed circuit board). Reference symbols S shown in FIG. 15 denote soldered portions.

Figure 16:
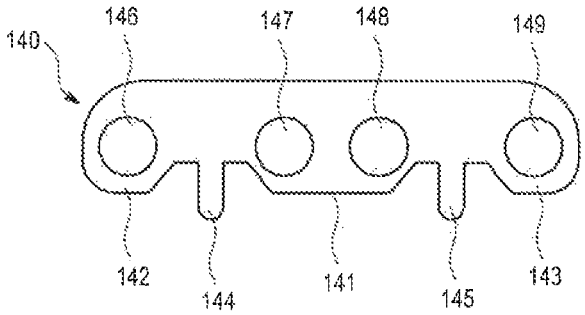
FIG. 16 is a front view illustrating a solder block employed to a connection device according to a seventh embodiment of the present invention.
Figure 17:
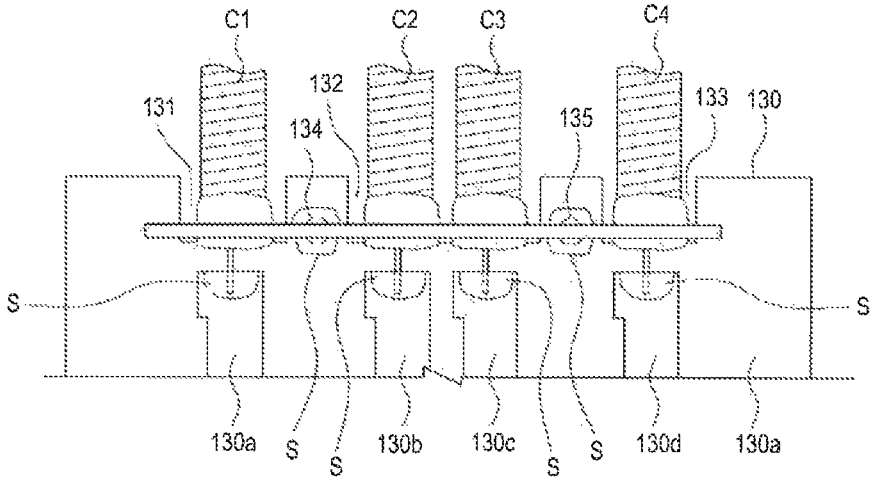
FIG. 17 is a plan view illustrating the connection device according to the seventh embodiment of the present invention.

A structure of a connection device according to the seventh embodiment of the present invention will be described with reference to FIGS. 16 and 17. As shown in FIGS. 16 and 17, the connection device according to the seventh embodiment of the present invention includes a printed circuit board 130 and a solder block 140. The printed circuit board 130 includes first, second, third and fourth signal transmission patterns 130*a*, 130*b*, 130*c* and 130*d* on one surface 130*a* thereof, and a pair of thru-holes 134 and 135 formed among the first, second and third cutout portions 131, 132 and 133. The first, second and third cutout portions 131, 132 and 133 mean spaces in which first, second and third central bodies 142, 141 and 143 of the solder block, which is described later, and the first, second, third and fourth coaxial RF cables C1, C2, C3 and C4 are inserted and soldered, and the first and second thru-holes 134 and 135 mean spaces in which auxiliary bodies 144 and 145 of the solder block described later are inserted and soldered, respectively. The thru-holes 134 and 135 are paired to include two openings.

The solder block 140 is a terminal which extends from an upper surface to a bottom surface of the printed circuit board 130 and is inserted into the first, second and third cutout portions 131, 132 and 133 and the thru-holes 135 and 136 and which in turn is soldered to the first, second, third and fourth signal transmission patterns 130*a*, 130*b*, 130*c* and 130*d* to stably connect the central lines of the first, second, third and fourth coaxial RF cables C1, C2, C3 and C4 to the first, second, third and fourth signal transmission patterns 130*a*, 130*b*, 130*b* and 130*d*. The solder block 140 includes the first, second and third central bodies 142, 141 and 143 and a pair of auxiliary bodies 144 and 145. The first, second and third central bodies 142, 141 and 143 have a downwardly protruding shape. The second central body 141 includes first and second openings 147 and 148, the first central body 142 includes a third supporting opening 146, and the third central body 143 includes a fourth supporting opening 149. The first, second, third and fourth openings 147, 148, 146 and 149 are formed in parallel. The first and second supporting openings 146 and 147 have an identical shape, and are symmetrically formed in the second central body 141 in parallel. In addition, the third and fourth supporting openings 146 and 149 are symmetric around the first and second supporting openings 147 and 148 and opposite to each other.

The auxiliary bodies 144 and 145 extend downwardly through the thru-holes 134 and 135 between the first and second central bodies 142 and 141, and between the first and third central bodies 141 and 143, respectively, and have a downwardly protruding shape. Further, the auxiliary bodies 144 and 145 extend downwardly rather than the first, second and third central bodies 142, 141 and 143. The first, second and third central bodies 142, 141 and 143 and the auxiliary bodies 144 and 145 are integrally manufactured. Further, the solder block 140 may be manufactured by pressing or etching a brass plate in a predetermined shape. Since the solder block 140 is manufactured in this process, it is possible to freely design parts and to easily change a shape.

When the solder block 140 having the structure as described above is inserted into the first, second and third cutout portions 131, 132 and 133 and the thru-holes 134 and 135, and the central lines of the first, second, third and fourth coaxial RF cables C1, C2, C3 and C4 are soldered to the first, second, third and fourth signal transmission patterns 130*a*, 130*b*, 130*c* and 130*d*, the first, second, third and fourth RF cables C1, C2, C3 and C4 are maintained by the solder block in a rigid connection state. Preferably, the connection device is soldered to the printed circuit board at positions where the central lines of the first, second, third and fourth coaxial RF cables C1, C2, C3 and C4 are adjacent to or in connect with the first, second, third and fourth patterns 130*a*, 130*b*, 130*c* and 130*d* respectively, and where the auxiliary bodies are inserted in the thru-holes 134 and 135, in order to maintain a stability of a connection state. Reference symbols S shown in FIG. 17 denote soldered portions.

Additionally, the solder block may be in contact with the first, second, third and fourth signal transmission patterns 130*a*, 130*b*, 130*c* and 130*d* and/or the first, second, third and fourth grounds (not shown, provided on a bottom surface of the printed circuit board).

In addition, the solder block 20, 40, 60, 80, 100, 120 or 140 employed to the connection device according to the various embodiments of the present invention is preferably soldered to the printed circuit board in an upright position, and more preferably is simultaneously connected to one surface (signal transmission pattern) and/or the other surface (ground).

The invention claimed is:

1. A cable connection device for connecting a coaxial RF cable to a printed circuit board which has a signal transmission pattern on one surface thereof and a ground surface on the other surface thereof, the device comprising:

a solder block connected to the printed circuit board, wherein the solder block comprises:

a central body having a supporting opening in which the coaxial RF cable is inserted; and a pair of auxiliary bodies extending upwards from both sides of the central body and being stepped in a protruding shape, and wherein the printed circuit board has a cutout portion where an edge of the printed circuit board is cutout and removed, and a pair of thru-holes is formed at both sides of the cutout portion, wherein the solder block is soldered to one surface and/or the other surface of the printed circuit board so that the central body and the auxiliary bodies protrude through and are inserted in the cutout portion and the thru-holes, and wherein at least one central body and cutout portion are provided, and at least one pair of auxiliary bodies and thru-holes are formed.

2. The cable connection device as claimed in claim 1, wherein step portions between the central body and the auxiliary body have a depth deep enough to allow a central line of a coaxial RF cable, which extends and is inserted in a supporting opening of a central body protruding through the cutout of the printed circuit board, to be in contact with the signal transmission pattern of the printed circuit board.

3. The cable connection device as claimed in claim 1, wherein step portions between the central body and the auxiliary body have a depth deep enough to allow a section surface of a coating prepared for a peripheral surface of the central line of the coaxial RF cable, which extends through and is inserted in a supporting opening of the central body protruding through the cutout portion of the printed circuit board, to come in close contact with a surface of the cutout portion of the printed circuit board in an insertion direction of the coaxial RF cable.

4. The cable connection device as claimed in claim 2, wherein the coaxial RF cable includes a central line, and a grounding coating for providing the central line with a grounding force, and wherein the solder block is soldered to the printed circuit board so that the ground of the printed circuit board is electrically connected to the grounding coating of the coaxial cable.

5. The cable connection device as claimed in claim 2, wherein the central line of the coaxial RF cable is electrically connected to the signal transmission pattern of the printed circuit board.

6. The cable connection device as claimed in claim 1, wherein the solder block is made from a brass plate.

7. The cable connection device as claimed in claim 3, wherein the coaxial RF cable includes a central line, and a grounding coating for providing the central line with a grounding force, and wherein the solder block is soldered to the printed circuit board so that the ground of the printed circuit board is electrically connected to the grounding coating of the coaxial cable.

8. The cable connection device as claimed in claim 3, wherein the central line of the coaxial RF cable is electrically connected to the signal transmission pattern of the printed circuit board.

* * * * *